US010943536B2

(12) United States Patent
Wang et al.

(10) Patent No.: US 10,943,536 B2
(45) Date of Patent: Mar. 9, 2021

(54) EXTERNAL COMPENSATION CIRCUIT AND METHOD, AND DISPLAY DEVICE

(71) Applicant: BOE Technology Group Co., Ltd., Beijing (CN)

(72) Inventors: Tangxiang Wang, Beijing (CN); Chen Song, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/441,064

(22) Filed: Jun. 14, 2019

(65) Prior Publication Data

US 2020/0074924 A1 Mar. 5, 2020

(30) Foreign Application Priority Data

Aug. 31, 2018 (CN) ..... 201811014979.2

(51) Int. Cl.
*G09G 3/3233* (2016.01)

(52) U.S. Cl.
CPC ... *G09G 3/3233* (2013.01); *G09G 2300/0426* (2013.01); *G09G 2320/0233* (2013.01)

(58) Field of Classification Search
CPC ..... G09G 3/3233; G09G 2300/0426; G09G 2320/0233; G09G 2320/045; G09G 2310/0297; G09G 2310/08; G09G 2310/027; G09G 2300/0814; G09G 3/3258

See application file for complete search history.

(56) References Cited

U.S. PATENT DOCUMENTS

| | | | | |
|---|---|---|---|---|
| 7,623,054 | B2 * | 11/2009 | Iriguchi | G09G 3/3688 330/253 |
| 9,343,015 | B2 | 5/2016 | Jo | |
| 9,424,770 | B2 * | 8/2016 | Kim | G09G 3/3233 |
| 9,997,123 | B2 * | 6/2018 | Takenaka | G09G 3/3648 |
| 10,354,590 | B2 * | 7/2019 | Nie | G09G 3/3275 |
| 10,665,190 | B2 * | 5/2020 | Lee | G09G 3/3688 |
| 2011/0130981 | A1 * | 6/2011 | Chaji | G09G 3/3233 702/58 |
| 2015/0061981 | A1 | 3/2015 | Lee et al. | |
| 2016/0203761 | A1 | 7/2016 | Zhang | |

(Continued)

FOREIGN PATENT DOCUMENTS

| | | | |
|---|---|---|---|
| CN | 104167177 | A | 11/2014 |
| CN | 104424893 | A | 3/2015 |

(Continued)

OTHER PUBLICATIONS

First office action of Chinese application No. 201811014979.2 dated Nov. 28, 2019.

*Primary Examiner* — Bryan Earles
(74) *Attorney, Agent, or Firm* — Fay Sharpe LLP

(57) ABSTRACT

Provided are an external compensation circuit and method, and display device in the field of display techniques. The external compensation circuit includes a regulation sub-circuit that may collect a driving current loaded to a light-emitting unit and a reference current from a reference current source, and regulate potentials at two nodes connected to a compensation sub-circuit according to the collected current, to enable the compensation sub-circuit to calibrate a data signal to be input to a pixel circuit according to a potential difference between the two nodes.

20 Claims, 7 Drawing Sheets

(56) References Cited

U.S. PATENT DOCUMENTS

| | | | |
|---|---|---|---|
| 2018/0130418 | A1 | 5/2018 | Zhu et al. |
| 2019/0156747 | A1 | 5/2019 | Nie et al. |

FOREIGN PATENT DOCUMENTS

| | | | |
|---|---|---|---|
| CN | 106067290 | A | 11/2016 |
| CN | 106328061 | A | 1/2017 |
| CN | 107146578 | A | 9/2017 |
| CN | 107358916 | A | 11/2017 |
| CN | 108109588 | A | 6/2018 |

* cited by examiner

EXTERNAL COMPENSATION CIRCUIT AND METHOD, AND DISPLAY DEVICE

CROSS-REFERENCE TO RELATED APPLICATION

This application claims priority to Chinese Patent Application No. 201811014979.2, filed on Aug. 31, 2018 and entitled "External Compensation Circuit and Method, and Display Device", the entire contents of which are incorporated herein by reference.

TECHNICAL FIELD

The present disclosure relates to the field of display technology, and more particularly to an external compensation circuit and method, and a display device.

BACKGROUND

An active matrix organic light-emitting diode (AMOLED) is a self-luminous current-type light-emitting device, and a driving transistor may be disposed in a pixel circuit to drive the AMOLED to emit light. However, the magnitude of the driving current flowing through the AMOLED is related to the threshold voltage Vth of the driving transistor. In order to avoid the problem that the drift of Vth causes the current flowing through the AMOLED to be different, the Vth may be compensated during the driving process.

In the related art, the compensating methods may include internal compensation method and external compensation method. The internal compensation method realizes compensation to the Vth by adding new thin film transistors and signal lines to the interior of the pixel circuit; and the external compensation method realizes compensation to the Vth by detecting the voltages at two terminals of the light-emitting device through an integrated circuit (IC) chip at the exterior of the panel and regulating the data signal according to the detected voltages.

SUMMARY

The present disclosure provides an external compensation circuit and method, and a display device. The technical solutions are as follows.

In a first aspect, there is provided an external compensation circuit, comprising: a regulation sub-circuit, and a compensation sub-circuit; wherein the regulation sub-circuit is connected to a reference current source, a current detection terminal of a pixel circuit, a first node and a second node respectively, and configured to regulate a potential at the first node and a potential at the second node according to a reference current provided by the reference current source, and configured to regulate the potential at the second node according to a collected driving current loaded to a light-emitting unit by the pixel circuit; and the compensation sub-circuit is connected to the first node, the second node, and a data signal terminal of the pixel circuit respectively, and configured to calibrate a data signal to be input to the pixel circuit according to a potential difference between the first node and the second node, and input the calibrated data signal to the pixel circuit.

Optionally, the regulation sub-circuit comprises: a current amplifying portion and a potential regulating portion; wherein the current amplifying portion is connected to the reference current source, the current detection terminal of the pixel circuit, a third node and a fourth node respectively, and configured to amplify a collected current, and input the current that is amplified to the potential regulating portion through the third node and the fourth node, wherein the current is the reference current or the driving current; and the potential regulating portion is connected to the first node, the second node, the third node and the fourth node respectively, and configured to regulate the potential at the first node and the potential at the second node according to the reference current that is amplified, and regulate the potential at the second node according to the driving current that is amplified.

Optionally, the current amplifying portion comprises: a first amplifier, a first resistance, a second resistance, a first switch, a second switch, a third switch, and a fourth switch; wherein a first input terminal of the first amplifier is connected to one terminal of the third switch, a second input terminal of the first amplifier is connected to a fifth node, and an output terminal of the first amplifier is connected to the third node, wherein another terminal of the third switch is connected to a direct current power source terminal; one terminal of the first resistance is connected to one terminal of the second switch, and another terminal of the first resistance is connected to the fourth node, wherein another terminal of the second switch is connected to the fifth node; one terminal of the second resistance is connected to the fourth node, and another terminal of the second resistance is connected to the direct current power source terminal; one terminal of the first switch is connected to the fifth node, and another terminal of the first switch is connected to the third node; and a first terminal of the fourth switch is connected to the fifth node, a second node of the fourth switch is connected to the reference current source, and a third terminal of the fourth switch is connected to the current detection terminal of the pixel circuit.

Optionally, the potential regulating portion comprises: a first transistor, a second transistor, a capacitor, and a fifth switch; wherein a gate of the first transistor is connected to the third node, a first electrode of the first transistor is connected to the second node, and a second electrode of the first transistor is connected to the fourth node; a gate of the second transistor is connected to the first node, a first electrode of the second transistor is connected to one terminal of the capacitor, and a second electrode of the second transistor is connected to the second node, wherein another terminal of the capacitor is connected to the first node; and one terminal of the fifth switch is connected to the first node, and another terminal of the fifth switch is connected to the second node.

Optionally, the compensation sub-circuit comprises: a control portion and a calibration portion; wherein the control portion is connected to the first node, the second node, and the calibration portion respectively, and configured to determine a compensation amount of a data signal according to the potential difference between the first node and the second node, and input the compensation amount to the calibration portion; and the calibration portion is further connected to the data signal terminal of the pixel circuit, and configured to calibrate the data signal to be input the pixel circuit according to the compensation amount received, and input a calibrated data signal to the pixel circuit.

Optionally, the compensation sub-circuit further comprises: a storage portion connected to the control portion; the storage portion is configured to store a corresponding relation between a potential difference and a compensation amount; and the control portion is configured to determine, according to the corresponding relation, a compensation amount corresponding to the potential difference between the first node and the second node as the compensation amount of the data signal.

Optionally, the external compensation circuit further comprises: a comparison sub-circuit; wherein the comparison sub-circuit is connected to the first node, the second node, and the compensation sub-circuit respectively, and configured to compare the potential at the first node with the potential at the second node, and input a comparison result to the compensation sub-circuit; and the compensation sub-circuit is configured to calibrate, when the potential at the first node is determined not to be equal to the potential at the second node according to the comparison result, the data signal to be input to the pixel circuit according to the potential difference between the first node and the second node.

Optionally, the comparison sub-circuit further comprises: a comparator; wherein a first input terminal of the comparator is connected to the first node, a second input terminal of the comparator is connected to the second node, and an output terminal of the comparator is connected to the compensation sub-circuit.

Optionally, the external compensation circuit further comprises: an amplification sub-circuit; wherein the amplification sub-circuit is connected to the first node, the second node, and the compensation sub-circuit respectively, and configured to amplify the potential difference and input the amplified potential to the compensation sub-circuit.

Optionally, the amplification sub-circuit comprises: a second amplifier; wherein a first input terminal of the second amplifier is connected to the first node, a second input terminal of the second amplifier is connected to the second node, and an output terminal of the second amplifier is connected to the compensation sub-circuit.

Optionally, the external compensation circuit further comprises: a digital-to-analog converting sub-circuit; wherein the digital-to-analog converting sub-circuit is connected to the compensation sub-circuit and the data signal terminal of the pixel circuit respectively, and configured to convert the calibrated data signal input by the compensation sub-circuit into an analog signal and input the analog signal to the pixel circuit.

Optionally, the regulation sub-circuit is further connected to the data signal terminal of the pixel circuit; and the digital-to-analog converting sub-circuit is connected to the data signal terminal of the pixel circuit through the regulation sub-circuit; the digital-to-analog converting sub-circuit comprises: a digital-to-analog converter and a sixth switch; wherein one terminal of the digital-to-analog converter is connected to the compensation sub-circuit, and another terminal of the digital-to-analog converter is connected to one terminal of the sixth switch; and another terminal of the sixth switch is connected to the regulation sub-circuit.

Optionally, the external compensation circuit further comprises: a comparison sub-circuit, an amplification sub-circuit, and a digital-to-analog converting sub-circuit; wherein the potential regulating portion comprises a first transistor, a second transistor, a capacitor, and a fifth switch; the comparison sub-circuit comprises a comparator; the amplification sub-circuit comprises a second amplifier; the compensation sub-circuit comprises a control portion, a calibration portion and a storage portion; and the digital-to-analog converting sub-circuit comprises a digital-to-analog converter and a sixth switch; wherein a gate of the first transistor is connected to the third node, a first electrode of the first transistor is connected to the second node, and a second electrode of the first transistor is connected to the fourth node; a gate of the second transistor is connected to the first node, a first electrode of the second transistor is connected to one terminal of the capacitor, and a second electrode of the second transistor is connected to the second node, and another terminal of the capacitor is connected to the first node; one terminal of the fifth switch is connected to the first node, and another terminal of the fifth switch is connected to the second node; a first input terminal of the comparator is connected to the first node, a second input terminal of the comparator is connected to the second node, and an output terminal of the comparator is connected to the control portion; a first input terminal of the second amplifier is connected to the first node, a second input terminal of the second amplifier is connected to the second node, and an output terminal of the second amplifier is connected to the control portion; the control portion is further connected to the calibration portion and the storage portion respectively, and the calibration portion is further connected to one terminal of the digital-to-analog converter; another terminal of the digital-to-analog converter is connected to one terminal of the sixth switch; and another terminal of the sixth switch is connected to the first input terminal of the first amplifier, and the output terminal of the first amplifier is further connected to the data signal terminal of the pixel circuit.

In another aspect, there is provided an external compensating method, applied to the external compensation circuit described above. The method comprises: a reset phase, in which the regulation sub-circuit collects a reference current provided by the reference current source, and regulates a potential at the first node and a potential at a second node according to the reference current; and a detecting phase, in which the regulation sub-circuit collects a driving current loaded to a light-emitting unit by the pixel circuit and regulates the potential at the second node according to the driving current, and the compensation sub-circuit calibrates a data signal to be input to the pixel circuit according to a potential difference between the first node and the second node, and inputs a calibrated data signal to the pixel circuit.

Optionally, the regulation sub-circuit comprises: a first amplifier, a first resistance, a second resistance, a first switch, a second switch, a third switch, a fourth switch, a first transistor, a second transistor, a capacitor, and a fifth switch; wherein in the reset phase, the first switch is switched off, the second switch, the third switch, and the fifth switch are switched on, and a first terminal and a second terminal of the fourth switch are coupled; and in the detecting phase, the first switch and the fifth switch are switched off, the second switch and the third switch are switched on, and the first terminal and a third terminal of the fourth switch are coupled.

Optionally, an output terminal of the first amplifier is further connected to the data signal terminal of the pixel circuit; the external compensation circuit further comprises: a digital-to-analog converting sub-circuit that comprises a digital-to-analog converter and a sixth switch, and the digital-to-analog converter is connected to a first input terminal of the first amplifier through the sixth switch; the method further comprises: a light-emitting phase; wherein, in the reset phase and the detecting phase, the sixth switch is opened; and in the light-emitting phase, the first switch and the sixth switch are switched on, the second switch, the third switch and the fifth switch are switched off, and the digital-to-analog converter inputs the calibrated data signal received to the data signal terminal of the pixel circuit through the sixth switch and the first amplifier, to drive the light-emitting unit connected to the pixel circuit to emit light.

Optionally, the external compensation circuit further comprises: a comparison sub-circuit and an amplification sub-circuit; wherein in the detecting phase, the comparison sub-circuit compares the potential at the first node with the potential at the second node, and inputs a comparison result to the compensation sub-circuit; the amplification sub-circuit amplifies the potential difference and inputs amplified potential difference to the compensation sub-circuit; and the compensation sub-circuit calibrates, when the potential at the first node is determined to be not equal to the potential at the second node according to the comparison result, the data signal to be input to the pixel circuit according to the potential difference between the first node and the second node.

In yet another aspect, there is provided a display device, comprising: a pixel circuit and the external compensation circuit described in the above aspect.

Optionally, the pixel circuit comprises: a first switching transistor, a second switching transistor, a driving transistor, and a storage capacitor; wherein a gate of the first switching transistor is connected to a first switching signal terminal, a first electrode of the first switching transistor, as a data signal terminal, is connected to the compensation sub-circuit, and a second electrode of the first switching transistor is connected to a gate of the driving transistor; a first electrode of the driving transistor is connected to a ground terminal, a second electrode of the driving transistor is connected to one terminal of the storage capacitor, another terminal of the storage capacitor is connected to a light-emitting unit; and a gate of the second switching transistor is connected to a second switching signal terminal, a first electrode of the second switching transistor is connected to one terminal of the storage capacitor, and a second electrode of the second switching transistor, as a current detection terminal, is connected to a third terminal of the fourth switch in the regulation sub-circuit.

Optionally, the compensation sub-circuit is connected to a first input terminal of the first amplifier in the regulation sub-circuit, and an output terminal of the first amplifier is connected to the data signal terminal.

BRIEF DESCRIPTION OF THE DRAWINGS

In order to describe the technical solutions in the embodiments of the present more clearly, the following briefly introduces the accompanying drawings required for describing the embodiments. Apparently, the accompanying drawings in the following description show merely some embodiments of the present disclosure, and a person of ordinary skill in the art may also derive other drawings from these accompanying drawings without creative efforts.

DETAILED DESCRIPTION

Figure 1:
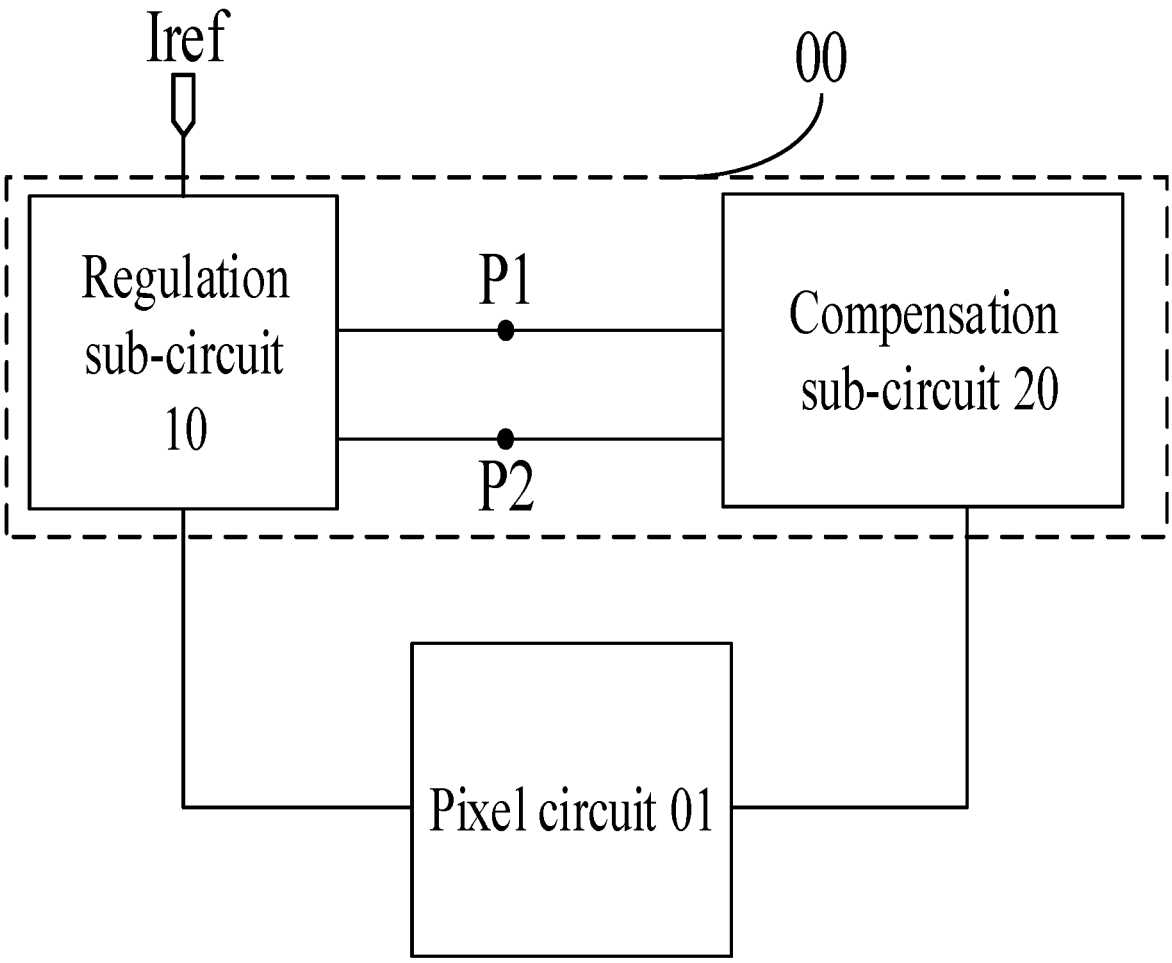
FIG. 1 is a schematic diagram of a structure of an external compensation circuit according to an embodiment of the present disclosure.

The embodiments of the present disclosure will be described in further detail with reference to the accompanying drawings, to present the objects, technical solutions, and advantages of the present disclosure more clearly.

The transistors employed in all embodiments of the present disclosure may all be field-effect transistors or other devices having the same property. According to the functions of the transistors in the circuit, the transistors employed in the embodiments of the present disclosure are mainly switching transistors. Since the source and drain of the switching transistor employed here are symmetrical, the source and drain thereof are interchangeable. In embodiments of the present disclosure, the source is referred to as a first electrode, and the drain is referred to as a second electrode. Alternatively, the drain is referred to as a first electrode, and the source is referred to a second electrode. According to the form of the transistor in the drawings, the middle terminal of the transistor is the gate, the signal input terminal is the source, and the signal output terminal is the drain. In addition, the switching transistors employed in embodiments of the present disclosure may include any one type of a P-type switching transistor and an N-type switching transistor. Here, the P-type switching transistor is switched on when the gate is at a low level, and switched off when the gate is at a high level; and the N-type switching transistor is switched on when the gate is at a high level, and switched off when the gate is at a low level. In addition, a plurality of signals in the embodiments of the present disclosure may all correspondingly have an effective potential and an ineffective potential. The effective potential and ineffective potential merely indicate that the potentials of the signals have two states, and do not indicate that the effective potential or the ineffective potential in the entire text has a specific value.

FIG. 1 is a schematic diagram of a structure of an external compensation circuit according to an embodiment of the present disclosure. As shown in FIG. 1, the external compensation circuit 00 may include: a regulation sub-circuit 10 and a compensation sub-circuit 20.

The regulation sub-circuit 10 may be connected to a reference current source Iref, a current detection terminal of a pixel circuit 01, a first node P1, and a second node P2 respectively. The regulation sub-circuit 10 may be configured to convert the reference current provided by the reference current source Iref to a reference potential, and input the reference potential into the first node P1 and the second node P2. That is, the regulation sub-circuit 10 may regulate the potential at the first node P1 and the potential at the second node P2 according to the reference current. The regulation sub-circuit 10 may be further configured to convert a collected driving current loaded to a light-emitting unit (not shown in FIG. 1) by the pixel circuit 01 into a driving potential, and input the driving potential to the second node P2. That is, the regulation sub-circuit 10 may regulate the potential at the second node P2 according to the driving current.

Here, the magnitude of the reference current provided by the reference current source Iref may be equal to the magnitude of the driving current output by the driving transistor in the pixel circuit under an ideal operating state.

The compensation sub-circuit 20 may be connected to the first node P1, the second node P2, and the data signal terminal of the pixel circuit 01 respectively, and configured to calibrate the data signal to be input to the pixel circuit 01 according to the potential difference between the first node P1 and the second node P1 (that is, the potential difference value between the reference potential and the driving potential), and input the calibrated data signal to the pixel circuit 01.

The difference value between the reference current and the driving current actually collected by the regulation sub-circuit 10 can reflect the drift of parameters of the driving transistor in the pixel circuit, such as, the threshold voltage and the electron mobility. In addition, the potential difference between the first node P1 and the second node P2 is directly proportional to the difference value between the reference current and the driving current. Thus, after the compensation sub-circuit 20 calibrates the data signal to be input to the pixel circuit 01 according to the potential difference, the compensation to the property drift of the driving transistor in the pixel circuit 01 may be realized.

In summary, the embodiment of the present disclosure provides an external compensation circuit. The external compensation circuit includes a regulation sub-circuit which can collect the driving current loaded to the light-emitting unit and the reference current of the reference current source, and regulate potentials at two nodes connected to the compensation sub-circuit, respectively, according to the collected current. Thereby, the compensation sub-circuit can calibrate the data signal according to the potential difference between the two nodes. The magnitude of the current signal collected by the regulation sub-circuit is not easily interfered by other devices in the circuit. Thus, the problem that the voltage signals are easily interfered during the wiring process in the case where voltage signals are directly collected may be avoided. In addition, since the accuracy of the current collected by the regulation sub-circuit is high, the accuracy of the potential difference acquired by the compensation sub-circuit is also high, which may thereby improve the accuracy of compensation of the compensation sub-circuit to the pixel circuit, and enhance the uniformity of the display brightness of the display device.

Figure 2:
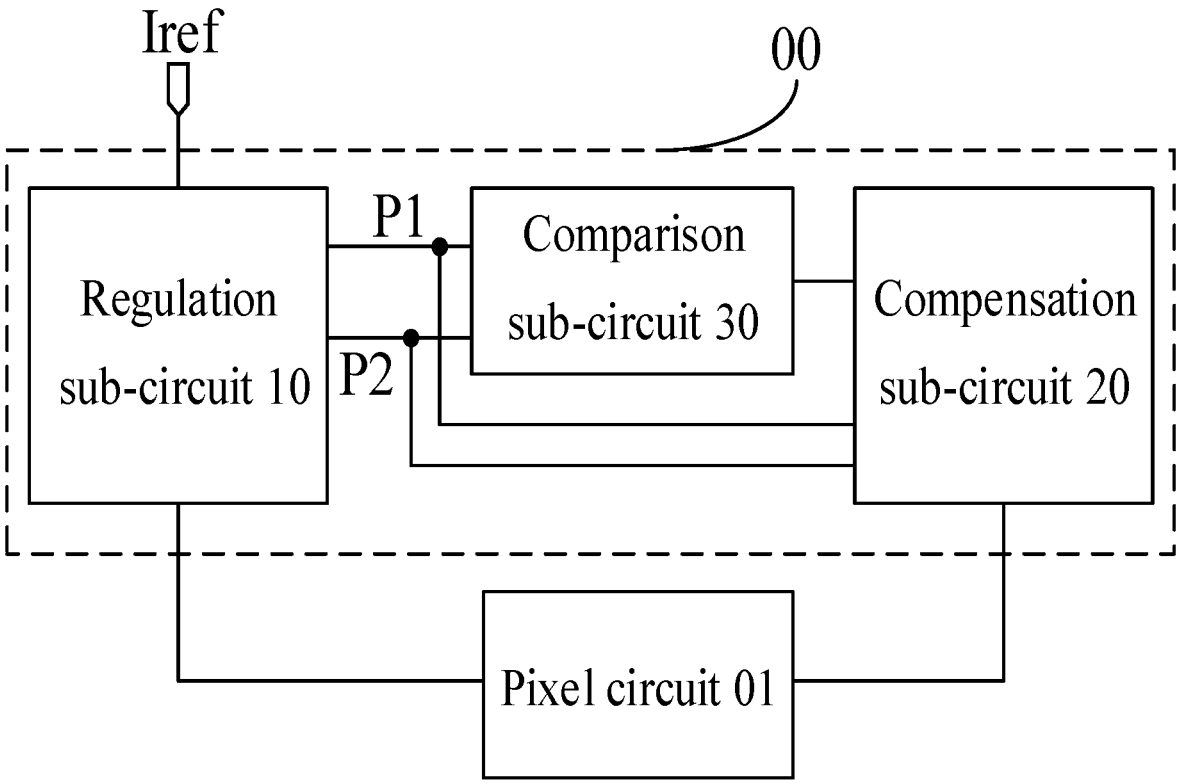
FIG. 2 is a schematic diagram of a structure of another external compensation circuit according to an embodiment of the present disclosure.

FIG. 2 is a schematic diagram of a structure of another external compensation circuit according to an embodiment of the present disclosure. As shown in FIG. 2, the external compensation circuit may further include a comparison sub-circuit 30.

The comparison sub-circuit 30 may be connected to the first node P1, the second node P2, and the compensation sub-circuit 20 respectively, and configured to compare the potential at the first node P1 with the potential at the second node P2, and input the comparison result to the compensation sub-circuit 20.

Correspondingly, the compensation sub-circuit 20 may be configured to calibrate, when the potential at the first node P1 is determined to be not equal to the potential at the second node P2 according to the comparison result, the data signal to be input to the pixel circuit 01 according to the potential difference between the first node P1 and the second node P2. When the potential at the first node P1 is determined to be equal to the potential at the second node P2, the compensation sub-circuit 20 may determine that no drift of property of the driving transistor in the pixel circuit 01 occurs, and thus there is no need to calibrate the data signal to be input to the pixel circuit 01.

Figure 3:
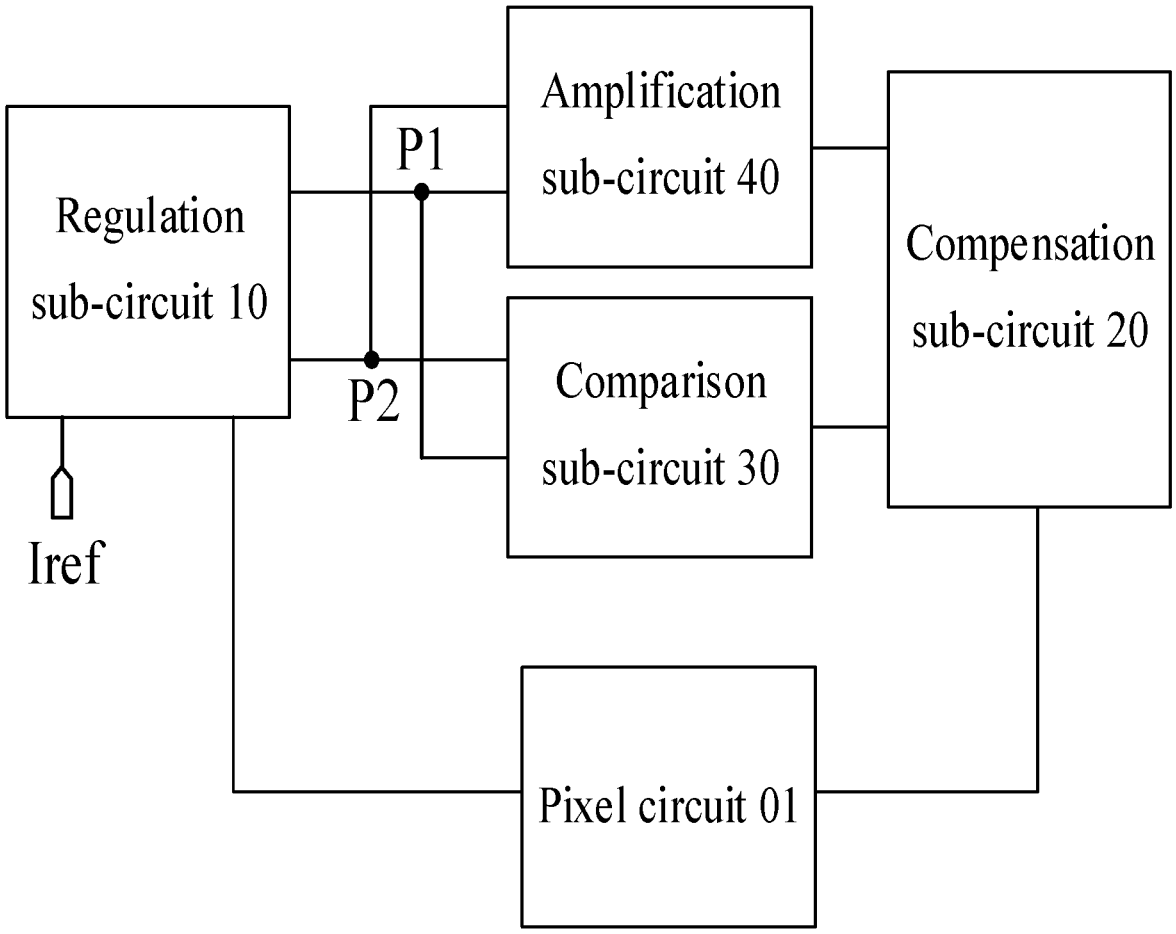
FIG. 3 is a schematic diagram of a structure of yet another external compensation circuit according to an embodiment of the present disclosure.

FIG. 3 is a schematic diagram of a structure of yet another external compensation circuit according to an embodiment of the present disclosure. As shown in FIG. 3, the external compensation circuit may further include an amplification sub-circuit 40 connected to the first node P1, the second node P2, and the compensation sub-circuit 20 respectively. The amplification sub-circuit 40 may be configured to amplify the potential difference between the first node P1 and the second node P2 and input amplified potential difference to the compensation sub-circuit 20.

In the embodiment of the present disclosure, by disposing the amplification sub-circuit 40 to amplify the potential difference and input amplified potential difference to the compensation sub-circuit 20, it's convenient for the compensation sub-circuit 20 to calibrate the data signal to be input to the pixel circuit 01 according to the amplified potential difference as received, which improves the calibration accuracy.

Figure 4:
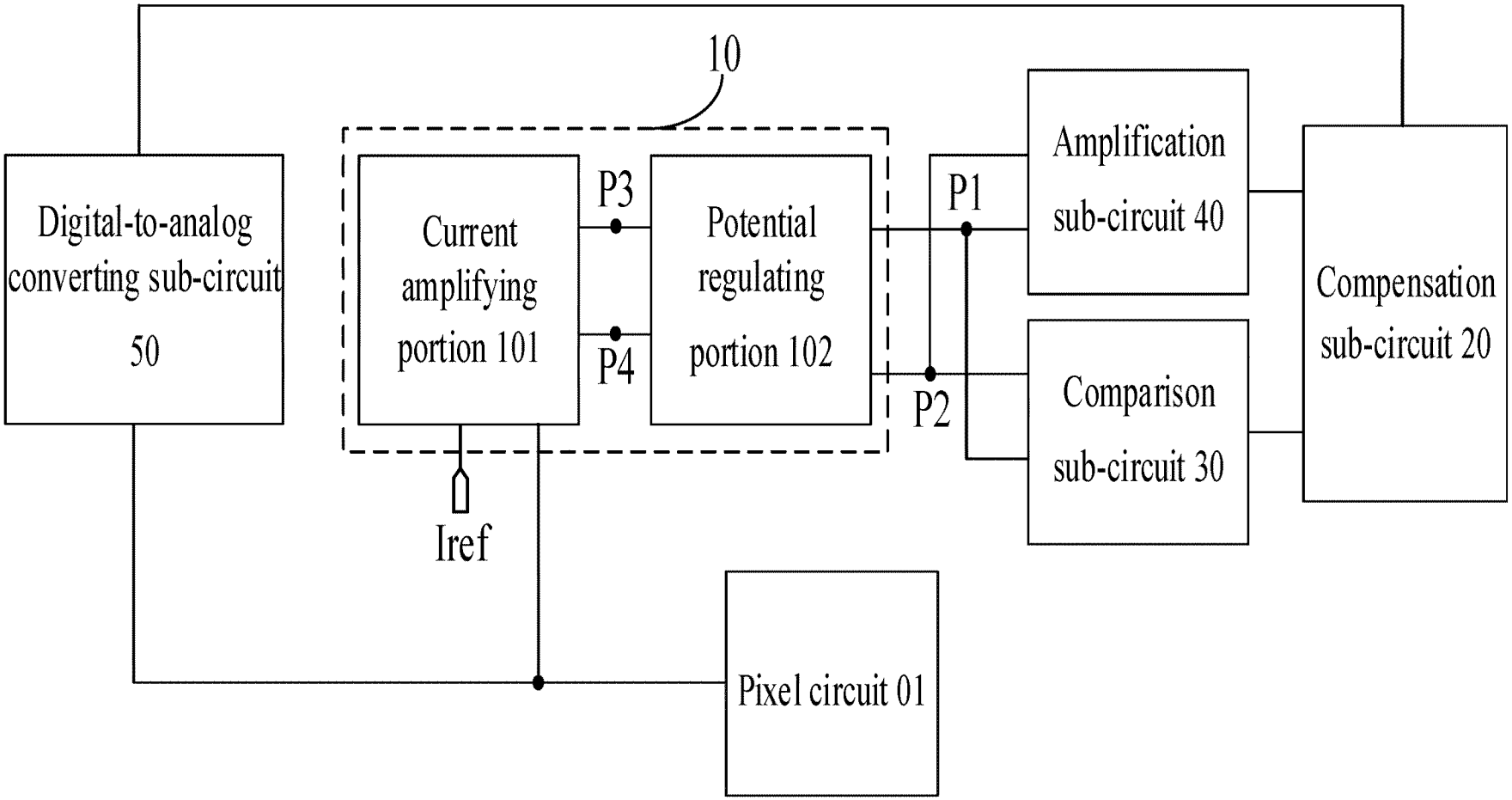
FIG. 4 is a schematic diagram of a structure of still yet another external compensation circuit according to an embodiment of the present disclosure.

FIG. 4 is a schematic diagram of a structure of still yet another external compensation circuit according to an embodiment of the present disclosure. As shown in FIG. 4, the regulation sub-circuit 10 may include a current amplifying portion 101 and a potential regulating portion 102.

The current amplifying portion 101 may be connected to the reference current source Iref, the current detection terminal of the pixel circuit 01, the third node P3, and the fourth node P4 respectively, and configured to amplify the collected current and then input the current that is amplified to the potential regulating portion 102 through the third node P3 and the fourth node P4.

Here, the current may be the reference current provided by the reference current source Iref or the driving current loaded by the pixel circuit 01 to the connected light-emitting unit. The magnitude of the current signal is not easily interfered by other devices in the circuit. Thus, the problem that the voltage signals are easily interfered during the wiring process when voltage signals are directly collected may be avoided. In addition, since the collected current is input to the potential regulating portion 102 after amplification, it's convenient for the potential regulating portion 102 to regulate the potential at each node based on the current, which improves the accuracy of the potential regulation, and thereby facilitates the comparison sub-circuit 30 to accurately compare the potential at the first node P1 with the potential at the second node P2.

Referring to FIG. 3, the potential regulating portion 102 may be connected to the first node P1, the second node P2, the third node P3, and the fourth node P4 respectively, and configured to regulate the potential at the first node P1 and the potential at the second node P2 according to the reference current, and regulate the potential at the second node P2 according to the driving current.

Figure 5:
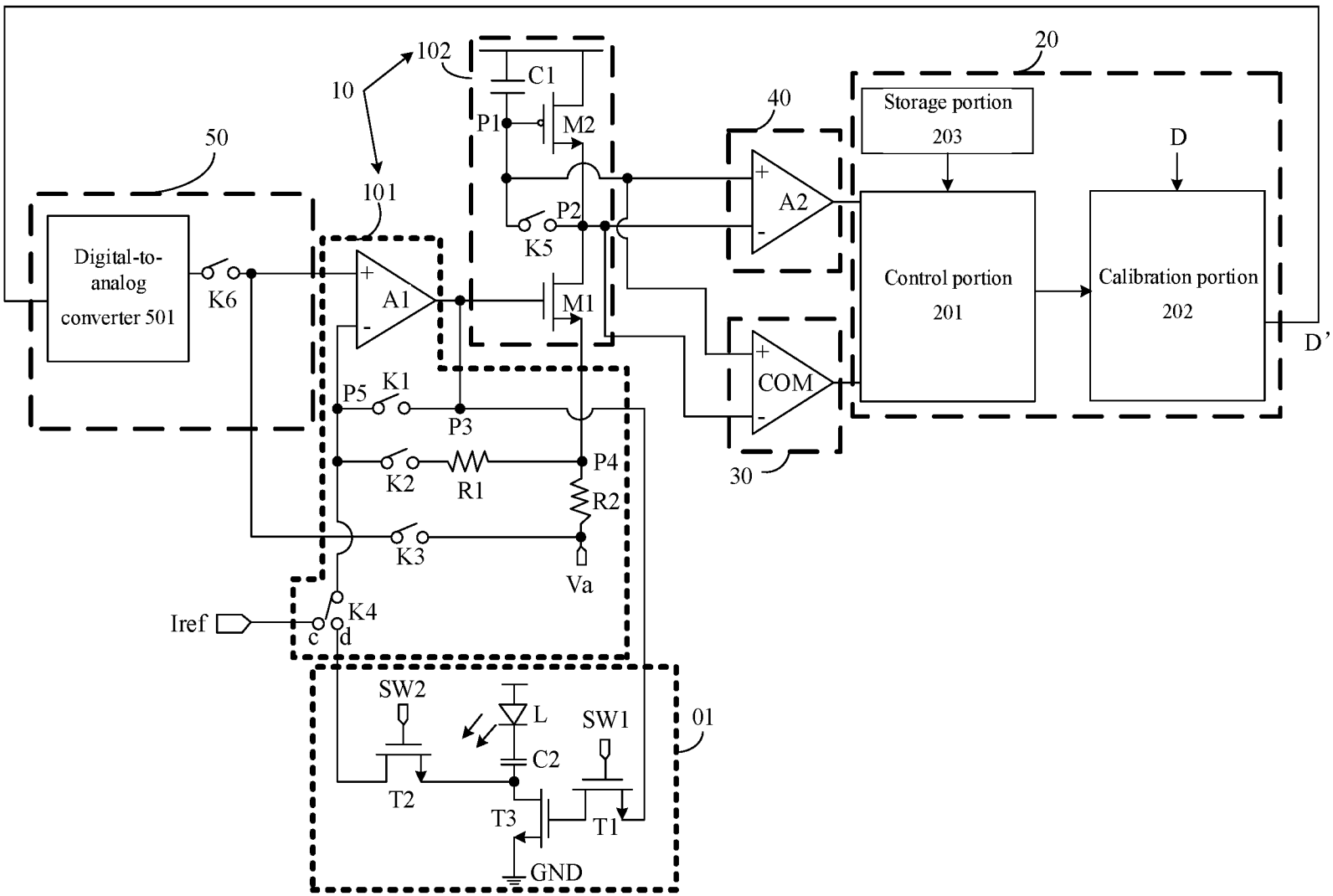
FIG. 5 is a schematic diagram of a structure of still yet another external compensation circuit according to an embodiment of the present disclosure.

FIG. 5 is a schematic diagram of a structure of still yet another external compensation circuit according to an embodiment of the present disclosure. As shown in FIG. 5, the current amplifying portion 101 may include a first amplifier A1, a first resistance R1, a second resistance R2, a first switch K1, a second switch K2, a third switch K3, and a fourth switch K4.

Here, the first input terminal of the first amplifier A1 may be connected to one terminal of the third switch K3, a second input terminal of the first amplifier A1 may be connected to a fifth node P5, and an output terminal of the first amplifier A1 may be connected to the third node P3. Another terminal of the third switch K3 may be connected to a direct current power source terminal Va.

One terminal of the first resistance R1 may be connected to one terminal of the second switch K2, and another terminal of the first resistance R1 may be connected to the fourth node P4. Another terminal of the second switch K2 may be connected to the fifth node P5.

One terminal of the second resistance R2 may be connected to the fourth node P4, and another terminal of the second resistance R2 may be connected to the direct current power source terminal Va.

One terminal of the first switch K1 may be connected to the fifth node P5, and another terminal of the first switch K1 may be connected to the third node P3.

The fourth switch K4 may be a single-pole double-throw switch. A first terminal of the fourth switch K4 may be connected to the fifth node P5, a second terminal c of the fourth switch K4 may be connected to the reference current source Iref, and a third terminal d of the fourth switch K4 may be connected to the current detection terminal of the pixel circuit 01.

In the embodiment of the present disclosure, referring to FIG. 5, when the first switch K1 is switched off, the second switch K2 and the third switch K3 are switched on, and the first terminal and the second terminal c of the fourth switch K4 are coupled, the first input terminal of the first amplifier A1 (that is, an in-phase input terminal +) is connected to the direct current power source terminal Va. Based on the virtual short principle of the amplifier, the potential at the second input terminal of the first amplifier A1 (that is, the potential at the fifth node P5) is equal to the potential of the direct current power source signal provided by the direct current power source terminal Va.

Assuming that in this case, the current flowing through the first transistor M1 is I0, the potential at the second electrode (that is, the source terminal) of the first transistor M1, namely the potential at the fourth node P4, may be: $Va+Iref\times R1=(I0-Iref)\times R2$. Thus, it can be calculated that the current I0 flowing through the first transistor M1 satisfies: $I0=(R1+R2)/R1\times Iref$. It can thus be seen that the current amplifying portion 101 may amplify all the currents as collected by $(R1+R2)/R1$ times and then provide the currents amplified to the potential regulating portion 102. Therefore, the amplified reference current input to the first node P1 and the second node P2 by the current amplifying portion 101 may be: $(R1+R2)/R1\times Iref$; and the amplified driving current input to the second node P2 by the current amplifying portion 101 may be $(R1+R2)/R1\times Ipiexl$. Here, Ipiexl is the driving current collected by the current amplifying portion 101.

Furthermore, it can determined that the potential difference ΔV between the first node P1 and the second node P2 satisfies: $\Delta V=(Iref-Ipixel)\times r0(R1+R2)/R1$, where r0 is an intrinsic resistance of the second transistor M2. Thus, in the embodiment of the present disclosure, the amplification factor at which the current is amplified by the current amplifying portion 101 can be adjusted by accurately setting the resistance value of the first resistor R1 and the resistance value of the second resistor R2.

Optionally, referring to FIG. 5, the potential regulating portion 102 may include a first transistor M1, a second transistor M2, a capacitor C1, and a fifth switch K5.

The gate of the first transistor M1 is connected to the third node P3, the first electrode of the first transistor M1 is connected to the second node P2, and the second electrode of the first transistor M1 is connected to the fourth node P4.

The gate of the second transistor M2 is connected to the first node P1, the first electrode of the second transistor M2 is connected to one terminal of the capacitor C1, and the second electrode of the second transistor M2 is connected to the second node P2. Another terminal of the capacitor C1 is connected to the first node P1.

One terminal of the fifth switch K5 is connected to the first node P1, and another terminal of the fifth switch K5 is connected to the second node P2.

When the current amplifying portion 101 provides the amplified reference current to the potential regulating portion 102, the first transistor M1 is turned on. In this case, the fifth switch K5 may be controlled to be switched off, to enable the second transistor M2 to be turned on. In this case, the second transistor M2 is equivalent to a diode, and the first transistor M1 and the second transistor M2 may regulate the potential at the first node P1 and the potential at the second node P2 based on the amplified reference current to equalize the potentials at the two nodes.

When the current amplifying portion 101 provides the amplified driving current to the potential regulating portion 102, the first transistor M1 is turned on. In this case, the fifth switch K5 may be controlled to be switched off, and the first node P1 may maintain at the previous potential under the action of the capacitor C1. The first transistor M1 regulates the potential at the second node P2 based on the amplified driving current.

In the embodiment of the present disclosure, the current amplifying portion 101 and the potential regulating portion 102 are adopted to amplify the collected current and regulate the potential at the first node P1 and the potential at the second node P2. Thus, compared with adoption of a capacitor integrator, the time required by the current amplifying portion 101 to collect the current and the potential regulating portion 102 to regulate the potential is shorter, and the efficiency is higher. In addition, the complexity of the circuit lowered, and the chip area is saved.

Referring to FIG. 5, the comparison sub-circuit 30 may include a comparator COM. A first input terminal of the comparator COM may be connected to the first node P1, a second input terminal of the comparator COM may be connected to the second node P2, and an output terminal of the comparator COM may be connected to the compensation sub-circuit 20.

Optionally, in the embodiment of the present disclosure, the comparator COM may be a potential comparator. It can be known from the working principle of the comparator that, when the potential collected by the in-phase input terminal + of the comparator COM is not equal to the potential of the inverting input terminal − of the comparator COM, the output terminal of the comparator COM outputs an effective level 1. Otherwise, the output terminal of the comparator COM outputs an ineffective level 0. That is, the output of the comparator COM has only two states, i.e., 0 or 1. Thus, according to the comparison result of the output of the comparator COM, the compensation sub-circuit 20 can accurately and quickly determine whether the data signal to be input to the pixel circuit 01 needs to be calibrated or not.

Furthermore, referring to FIG. 5, the first input terminal (that is, the in-phase input terminal +) of the comparator COM is connected to the first node P1, and the potential at the first node P1 can be detected. The second input terminal (that is, the inverting input terminal −) of the comparator COM is connected to the second node P2, and the potential at the second node P2 can be detected. Thus, in the embodiment of the present disclosure, the comparator COM can compare the magnitude of potential at the first node P1 with the magnitude of potential at the second node P2.

When the potential at the first node P1 is not equal to the potential at the second node P2, the comparator COM may output the effective level 1 to the compensation sub-circuit 20. In this case, the compensation sub-circuit 20 may determine that the potential at the first node P1 is not equal to the potential at the second node P2 according to the comparison result 1, and may calibrate the data signal to be input to the pixel circuit 01 according to the potential difference between the two nodes, and input the calibrated data signal to the pixel circuit 01.

When the potential at the first node P1 is equal to the potential at the second node P2, the comparator COM may output the ineffective level 0 to the compensation sub-circuit 20. In this case, the compensation sub-circuit 20 may determine that the potential at the first node P1 is equal to the potential at the second node P2 according to the comparison result 0, and may directly input the data signal received to the pixel circuit 01, without calibrating the data signal D.

Optionally, as shown in FIG. 5, the amplification sub-circuit 40 may include a second amplifier A2. The first input terminal of the second amplifier A2 may be connected to the first node P1, the second input terminal of the second amplifier A2 may be connected to the second node P2, and the output terminal of the second amplifier A2 may be connected to the compensation sub-circuit 20.

Optionally, referring to FIG. 5, the compensation sub-circuit 20 may include a control portion 201 and a calibration portion 202.

The control portion 201 may be connected to the first node P1, the second node P2, and the calibration portion 202 respectively, and configured to determine the compensation amount (such as, a compensation voltage) of the data signal according to the potential difference between the first node P1 and the second node P2, and input the compensation amount to the calibration portion 202.

Exemplarily, referring to FIG. 4, the control portion 021 may be connected to the output terminal of the comparator COM in the comparison sub-circuit 30 and the output terminal of the second amplifier A2 in the amplification sub-circuit 40 respectively. When the potential at the first node P1 is determined to be not equal to the potential at the second node P2 according to the comparison result sent by the comparator COM, the control portion 201 may determine the compensation amount of the data signal according to the amplified potential difference sent by the second amplifier A2.

The calibration portion 202 may be further connected to the data signal terminal of the pixel circuit 01, and configured to calibrate the data signal D to be input to the pixel circuit 01 according to the compensation amount received, and input the calibrated data signal D' to the pixel circuit 01.

Optionally, as shown in FIG. 4, the compensation sub-circuit 20 may further include a storage portion connected to the control portion 201. The storage portion 203 may store in advance a corresponding relation between the potential difference and the compensation amount in a form of, for example, table. The control portion 201 may determine a compensation amount, in the corresponding relation, corresponding to the potential difference between the first node P1 and the second node P2 as the compensation amount of the data signal.

Exemplarily, the storage portion 203 may be a memory integrated in the control portion 201, or may be a memory independent from the control portion 201.

Optionally, referring to FIG. 4, the external compensation circuit 00 may further include a digital-to-analog converting sub-circuit 50.

The digital-to-analog converting sub-circuit 50 may be connected to the compensation sub-circuit 20 and the data signal terminal of the pixel circuit 01 respectively, and may be configured to convert the calibrated data signal input by the compensation sub-circuit 20 into an analog signal and then input the analog signal to the pixel circuit 01.

Optionally, referring to FIG. 5, the output terminal of the first amplifier A1 in the regulation sub-circuit 10 may further be connected to the data signal terminal of the pixel circuit 01. Correspondingly, the digital-to-analog converting sub-circuit 50 may be connected to the data signal terminal of the pixel circuit 01 through the regulation sub-circuit 10. As shown in FIG. 5, the digital-to-analog converting sub-circuit 50 may include a digital-to-analog converter 501 and a sixth switch K6.

One terminal of the digital-to-analog converter 501 may be connected to the compensation sub-circuit 20 and another terminal of the digital-to-analog converter 501 may be connected to one terminal of the sixth switch K6.

Another terminal of the sixth switch K6 may be connected to the first input terminal of the first amplifier A1 in the regulation sub-circuit 10. Accordingly, the digital-to-analog converter 501 may be connected to the data signal terminal of the pixel circuit 01 through the sixth switch K6 and the first amplifier A1.

In the embodiment of the present disclosure, when both the sixth switch K6 and the first switch K1 are switched off, the digital-to-analog converter 501 may be connected to the data signal terminal of the pixel circuit 01 through the first amplifier A1 in the regulation sub-circuit 10. In this case, the first amplifier A1 may amplify the data signal sent by the digital-to-analog converter 501 and input the amplified data signal to the pixel circuit 01, to improve the display effect of the display device.

In the embodiment of the present disclosure, when the first amplifier A1 inputs data signals to the pixel circuit 01 to drive the light-emitting unit to emit light, the first amplifier A1 may serve as a buffer. The buffer can buffer the data signal input from the digital-to-analog converting sub-circuit 50 to the pixel circuit 01, thereby driving the light-emitting unit to emit light. By reusing the first amplifier A1, the area occupied by the external compensation circuit may be saved, which further reduces the complexity of the external compensation circuit.

Furthermore, referring to FIG. 5, the pixel circuit 01 may include a first switching transistor T1, a second switching transistor T2, a driving transistor T3, and a storage capacitor C2.

The gate of the first switching transistor T1 may be connected to a first switching signal terminal SW1, the first electrode of the first switching transistor T1, as the data signal terminal of the pixel circuit 01, may be connected to the third node P3, and the second electrode of the first switching transistor T1 may be connected to the gate of the driving transistor T3.

The gate of the second switching transistor T2 may be connected to a second switching signal terminal SW2, a first electrode of the second switching transistor T2 may be connected to one terminal of the storage capacitor C2, and the second electrode of the second switching transistor T2, as a current detection terminal of the pixel circuit 10, may be connected to the third terminal d of the fourth switch K4. Another terminal of the storage capacitor C2 may be connected to a terminal of the light-emitting unit L (for example, as shown in FIG. 5, another terminal of the storage capacitor C2 may be connected to the cathode of the light-emitting unit L).

The first electrode of the driving transistor T3 may be connected to a ground terminal GND, and the second electrode of the driving transistor T3 may be connected to one terminal of the storage capacitor C2.

The first amplifier A1 in the external compensation circuit may be configured to not only amplify the collected current, but also provide a data signal to the pixel circuit. Thus, during the process of providing the data signal to the pixel circuit 01 by the external compensation circuit, the second switching signal terminal SW2 may provide a second switching signal at an ineffective potential, and the first terminal and the third terminal d of the fourth switch K4 may be coupled, to avoid signal interference and ensure normal operation of the external compensation circuit. Here, the external compensation circuit 00 cannot collect the driving current flowing through the light-emitting unit L or the reference current of the reference current source Iref, thereby avoiding influence on the normal output of data signals. Thus, by providing the second switching transistor T2, when the external compensation circuit inputs data signals to the pixel circuit to drive the light-emitting unit L to emit light, the problem that data signals cannot be output normally caused by continuous connection of current by the external compensation circuit can be avoided.

Optionally, in the embodiment of the present disclosure, the second switching transistor T2 may also be not disposed. In this case, the fourth switch K4 may be a single-pole three-throw switch, that is the fourth switch K4 may further include a fourth terminal, and the fourth terminal may be grounded. When the external compensation circuit provides the data signal to the pixel circuit, the first terminal and the fourth terminal of the fourth switch K4 may be coupled. In this case, the external compensation circuit cannot collect the driving current flowing through the light-emitting unit or the reference current of the reference current source Iref, thereby ensuring that the external compensation circuit can output the data signal normally. In addition, by employing the fourth switch K4 to replace the second switching transistor T2, the area occupied by the external compensation circuit may be further reduced, thereby saving the cost and reducing the power consumption.

In the embodiment of the present disclosure, the data signal D may be input to the first switching transistor T1 through the third node P3. The first switching transistor T1 may be turned on under the control of a gate driving signal provided by the first switching signal terminal SW1, so that the data signal D is written into the gate of the driving transistor T3, and the driving transistor T3 may provide a driving current to the light-emitting unit L based on the data signal D.

It should be noted that the pixel circuit in the embodiment of the present disclosure may be other structures including more transistors, in addition to the structure of 2T1C (that is, two transistors and one capacitor) shown in FIG. 5, which is not limited in the embodiment of the present disclosure.

It should also be noted that each of the above-described embodiments is described by taking an example in which the second transistor M2 is a P-type transistor, and the first transistor M1, the first switching transistor T1, the second switching transistor T2, and the driving transistor T3 are all N-type transistors. Certainly, the second transistor M2 may be an N-type transistor, and the first transistor M1, the first switching transistor T1, the second switching transistor T2, and the driving transistor T3 may all be P-type transistors. For an N-type transistor, the effective potential may be a high potential relative to the ineffective potential. For a P-type transistor, the effective potential is a low potential relative to the ineffective potential.

In summary, the embodiment of the present disclosure provides an external compensation circuit. The external compensation circuit may include a regulation sub-circuit that collects the driving current loaded to the light-emitting unit and the reference current of the reference current source, and may regulate potentials at two nodes connected to the compensation sub-circuit according to the collected current, which thereby enables the compensation sub-circuit to calibrate the data signal according to the potential difference between the two nodes. The magnitude of the current signal is not easily interfered by other devices in the circuit. Thus, as the problem that the voltage signals are easily interfered during the wiring process when voltage signals are directly collected may be avoided. In addition, since the accuracy of the current collected by the regulation sub-circuit is high, the voltage input to the compensation sub-circuit also has a high accuracy, which may thereby improve the compensation accuracy of the compensation sub-circuit to the pixel circuit, and enhance the uniformity of display of the display device.

Figure 6:
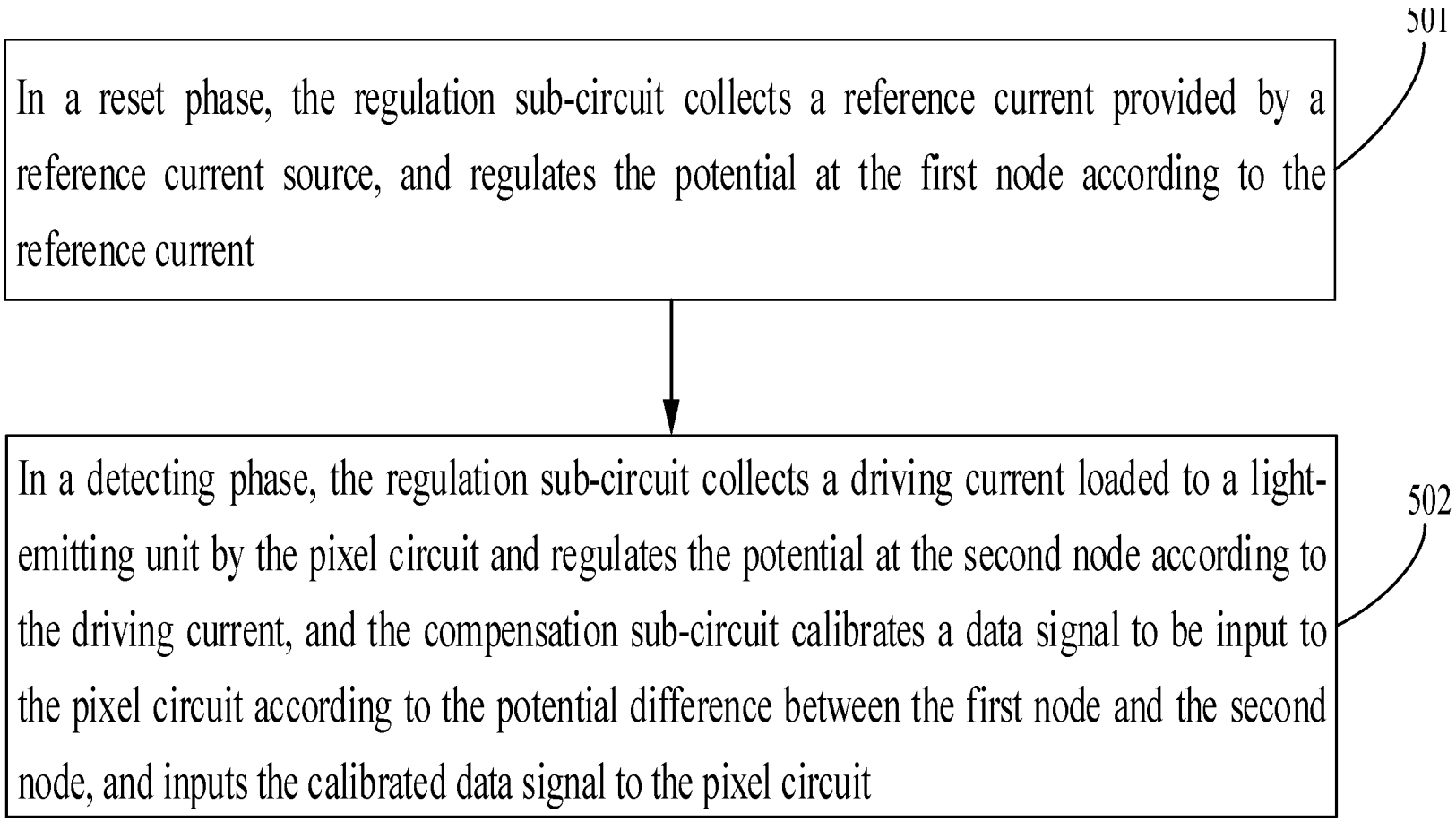
FIG. 6 is a flowchart of a compensating method according to an embodiment of the present disclosure.

FIG. 6 is a flowchart of a compensating method according to an embodiment of the present disclosure. The method may be applied to any one of the external compensation circuits shown in FIG. 1 to FIG. 5. As shown in FIG. 6, the method may include following steps.

In step 501, in a reset phase, the regulation sub-circuit collects a reference current provided by a reference current source, and regulates the potential at the first node according to the reference current.

In step 502, in a detecting phase, the regulation sub-circuit collects a driving current loaded to a light-emitting unit by the pixel circuit and regulates the potential at the second node according to the driving current, and the compensation sub-circuit calibrates a data signal to be input to the pixel circuit according to the potential difference between the first node and the second node, and inputs the calibrated data signal to the pixel circuit.

In summary, the embodiment of the present disclosure provides an external compensating method. According to the external compensating method, the driving current loaded to the light-emitting unit and the reference current from the reference current source may be collected, and potentials at two nodes connected to the compensation sub-circuit may be regulated according to the collected current, to enable the compensation sub-circuit to calibrate the data signal according to the potential difference between the two nodes. The magnitude of the current signal is not easily interfered by other devices in the circuit. Thus, the problem that the voltage signals are easily interfered during the wiring process when voltage signals are directly collected may be avoided. In addition, since the accuracy of current collected by the regulation sub-circuit is high, the voltage input to the compensation sub-circuit also has a high accuracy, which can thereby improve the compensation accuracy of the compensation sub-circuit to the pixel circuit, and enhance the uniformity of display of the display device.

In the embodiment of the present disclosure, referring to FIG. 3, the external compensation circuit may further include a comparison sub-circuit 30 that is connected to the first node P1, the second node P2, and the compensation sub-circuit 20 respectively, and an amplification sub-circuit 40 that is connected to the first node P1, the second node P2, and the compensation sub-circuit 20 respectively.

Correspondingly, in the detecting phase shown in the step 502, the comparison sub-circuit 30 may compare the potential at the first node with the potential at the second node, and then input the comparison result to the compensation sub-circuit 20. The amplification sub-circuit 40 may further amplify the potential difference between the first node and the second node and input the amplified potential difference to the compensation sub-circuit 20.

When the potential at the first node is determined to be not equal to the potential at the second node according to the comparison result, the compensation sub-circuit 20 may calibrate the data signal to be input to the pixel circuit according to the potential difference as received, to improve the compensation accuracy. When the potential at the first node is determined to be equal to the potential at the second node according to the comparison result, the compensation sub-circuit 20 may directly provide the data signal to the pixel circuit, without calibrating the data signal to be input to the pixel circuit.

Furthermore, referring to FIG. 4 and FIG. 5, the regulation sub-circuit 10 may include a current amplifying portion 101 and a potential regulating portion 102. The current amplifying portion 101 may include a first amplifier A1, a first resistance R1, a second resistance R2, a first switch K1, a second switch K2, a third switch K3, and a fourth switch K4. The potential regulating portion 102 may include a first transistor M1, a second transistor M2, a capacitor C, and a fifth switch K5.

Correspondingly, in the reset phase 501, the first switch K1 is switched of, and the second switch K2, the third switch K3, and the fifth switch K5 are switched on. The first terminal and the second terminal c of the fourth switch K4 are coupled. In this case, the current amplifying portion 101 may amplify the collected reference current and input the reference current to the potential regulating portion 102 through the third node P3 and the fourth node P4. The first transistor M1 and the second transistor M2 in the potential regulating portion 102 are both turned on, and the potential regulating portion 102 may regulate the potential at the first node P1 and the potential at the second node P2 according to the reference current.

In the detecting phase 502, the first switch K1 and the fifth switch K5 are switched off, the second switch K2 and the third switch K3 are switched on, and the first terminal and the third terminal d of the fourth switch are coupled. In this case, the current amplifying portion 101 may amplify the driving current and input the driving current to the potential regulating portion 102 through the third node P3 and the fourth node P4. The first transistor M1 in the potential regulating portion 102 is turned on, and the potential regulating portion 102 may regulate the potential of the second node P2 according to the driving current. In addition, since the fifth switch K5 is switched off in the detecting phase 502, the capacitor C may enable the first node P1 to maintain the potential in the reset phase. The comparison sub-circuit 30 connected to the first node P1 and the second node P2 may compare the potentials at the two nodes and input the comparison result to the compensation sub-circuit 20.

Furthermore, referring to FIG. 4 and FIG. 5, the external compensation circuit may further include a digital-to-analog converting sub-circuit 50, and the digital-to-analog converting sub-circuit 50 may include a digital-to-analog converter 501 and a sixth switch K6. Here, the digital-to-analog converter 501 is connected to the first input terminal of the first amplifier A1 in the regulation sub-circuit 10 through the sixth switch K6, and the output terminal of the first amplifier A1 is further connected to the data signal terminal of the pixel circuit 01.

The external compensating method may further include a light-emitting phase. In the reset phase and the detecting phase, the sixth switch K6 is switched off. In the light-emitting phase, the first switch K1 and the sixth switch K6 are switched on, and the second switch K2, the third switch K3 and the fifth switch K5 are switched off. The digital-to-analog converter 501 may input the calibrated data signal as received to the data signal terminal of the pixel circuit 01 through the sixth switch K6 and the first amplifier A1 in the regulation sub-circuit 01, to drive the light-emitting unit L connected to the pixel circuit 01 to emit light. By converting the calibrated data signal D' into an analog signal and then inputting the analog signal to the pixel circuit 01 through the regulation sub-circuit 10, amplification of the analog signal may be realized, and the display effect of the display device may thereby be improved.

Figure 7:
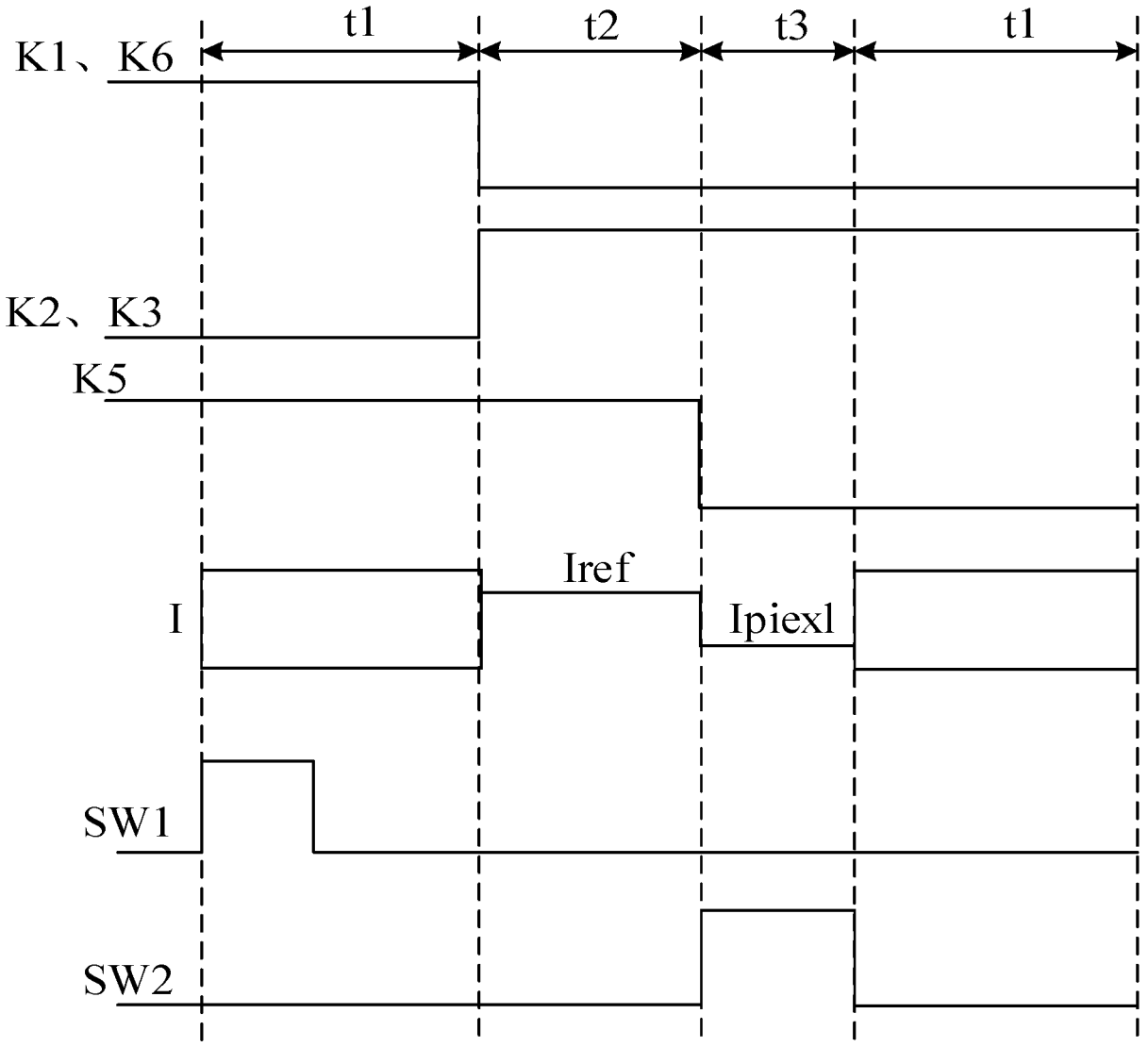
FIG. 7 is a timing sequence diagram of a driving process of an external compensation circuit according to an embodiment of the present disclosure.

In the embodiment of the present disclosure, referring to FIG. 6, the pixel circuit 01 may include a first switching transistor T1, a second switching transistor T2, a driving transistor T3, and a storage capacitor C2. FIG. 7 is a timing sequence diagram of a driving process of an external compensation circuit according to an embodiment of the present disclosure. The driving principle of the external compensation circuit provided in the embodiment of the present disclosure is illustrated in detail by taking the external compensation circuit shown in FIG. 5 as an example, and also by taking an example where the second transistor M2 is a P-type transistor, and the first transistor M1, the first switching transistor T1, the second switching transistor T2, and the driving transistor T3 are all N-type transistors.

As shown in FIG. 7, in the light-emitting phase t1, the first switch K1 and the sixth switch K6 are switched on, and the digital signal is digital-to-analog converted by the digital-to-analog converter 501 and amplified by the first amplifier A1, and then is input to the first electrode of the first switching transistor T1 (that is, the data signal terminal of the pixel circuit 01). In this case, the first switching signal terminal SW1 provides a first switching signal at an effective potential, and the first switching transistor T1 is turned on. The data signal is input to the driving transistor T3 through the first switching transistor T1, and the driving transistor T3 is turned on. Afterwards, the first switching signal terminal SW1 provides a first switching signal at an ineffective potential, and the first switching transistor T1 is turned off. The driving transistor T3 may drive the light-emitting unit L to emit light under the control of the data signal. In addition, in the light-emitting phase t1, the second switch K2, the third switch K3 and the fifth switch K5 are all switched off, and the first terminal and the third terminal d of the fourth switch K4 are coupled. The second switching signal terminal SW2 provides a second switching signal at an ineffective potential, and the second switching transistor T1 is turned off.

In the resetting phase t2, the first switch K1 and the sixth switch K6 are both switched off, the second switch K2, the third switch K3 and the fifth switch K5 are switched on, and the first terminal and the second terminal c of the fourth switch K4 are coupled. The reference current source Iref inputs a reference current to the fifth node P5 of the current amplifying portion 101 through the fourth switch K4. The collected reference current may be amplified by (R1+R2)/R1 times under the action of the first amplifier A1, the first resistor R1, and the second resistor R2 in the current amplifying portion 102. The first transistor M1 in an on state may regulate the potential at the first node P1 and the potential at the second node P2 based on the amplified reference current.

In addition, in the reset phase t2, the first switching signal terminal SW1 and the second switching signal terminal SW2 both provide switching signals at an ineffective potential, and both the first switching transistor T1 and the second switching transistor T2 are turned off. The light-emitting unit does not emit light.

In the detecting phase t3, the first switch K1, the fifth switch K5 and the sixth switch K6 are switched off, the second switch K2 and the third switch K3 are switched on, and the first terminal and the third terminal d of the fourth switch K4 are coupled. The second switching signal terminal SW2 provides a gate driving signal at an effective potential, and the second switching transistor T2 is turned on. The driving current output by the driving transistor T3 to the light-emitting unit L may be input to the current amplifying portion 101 through the second switching transistor T2 and the fourth switch K4. That is, the current amplifying portion 101 may collect the driving current Ipixel output by the driving transistor T3. The driving current Ipixel as collected may be amplified by (R1+R2)/R1 times under the action of the first amplifier A1, the first resistor R1, and the second resistor R2 in the current amplifying portion 101. The first transistor M1 in an on state may regulate the potential at the second node P2 based on the amplified driving current. Since the fifth switch K5 is switched off, the capacitor C1 may enable the first node P1 to maintain the potential in the reset phase t2.

In addition, in the detecting phase t2, the first switching signal terminal SW1 provides a first switching signal at an ineffective potential, and the first switching transistor T1 is turned off. The comparison sub-circuit 30 connected to the first node P1 and the second node P2 may compare the potentials at the two nodes and input the comparison result to the compensation sub-circuit 20. When the potentials at the two nodes are determined to be not equal according to the comparison result, the compensation sub-circuit 20 may calibrate the data signal D to be input to the pixel circuit 01 according to the potential difference between the first node P1 and the second node P2, and then input the calibrated data signal D' to the pixel circuit 01. That is, the light-emitting phase t1 is further performed. After the light-emitting phase t1, the external compensation circuit may continue to perform the reset phase t2 and the detecting phase t3.

It should be noted that each of the above-described embodiments is described by taking an example where the second transistor M2 is a P-type transistor, and the first transistor M1, the first switching transistor T1, the second switching transistor T2, and the driving transistor T3 are all N-type transistors. Certainly, the second transistor M2 may be an N-type transistor, and the first transistor M1, the first switching transistor T1, the second switching transistor T2, and the driving transistor T3 may all be P-type transistors. For an N-type transistor, the effective potential is a high potential relative to the ineffective potential. For a P-type transistor, the effective potential is a low potential relative to the ineffective potential.

In summary, the embodiment of the present disclosure provides an external compensating method. According to the external compensating method, the driving current loaded to the light-emitting unit and the reference current from the reference current source may be collected, and potentials at two nodes connected to the compensation sub-circuit may be regulated respectively according to the collected current, to enable the compensation sub-circuit to calibrate the data signal according to the potential difference between the two nodes. The magnitude of the current signal is not easily interfered by other devices in the circuit. Thus, the problem that the voltage signals are easily interfered during the wiring process when voltage signals are directly collected may be avoided. In addition, since the accuracy of current collected by the regulation sub-circuit is high, the voltage input to the compensation sub-circuit also has a high accuracy, which may thereby improve the compensation accuracy of the compensation sub-circuit to the pixel circuit, and enhance the uniformity of the display of the display device.

The embodiment of the present disclosure provides a display device. The display device may include a pixel circuit and any one of the external compensation circuits as shown in FIG. 1 to FIG. 5 which is connected to the pixel circuit.

Optionally, the compensation sub-circuit 20 in the external compensation circuit 00 may be integrated in a timing sequence controller, and the digital-to-analog converting sub-circuit 50 may be integrated in a source driving circuit. The timing sequence controller may be connected to each switch in the regulation sub-circuit 10 and the switch in the digital-to-analog converting sub-circuit 50, and may be configured to control the switching state of each switch.

Optionally, the display device may include a display panel, and a plurality of pixel circuits may be arranged in the display panel in an array. Here, each column of pixel circuits may be connected to an external compensation circuit. In addition, a plurality of external compensation circuits may share a compensation sub-circuit 20 and a digital-to-analog converting sub-circuit 50.

In the embodiment of the present disclosure, the display device may be any product or part having a display function, such as a liquid crystal panel, a piece of electronic paper, an OLED panel, an AMOLED panel, a mobile phone, a tablet computer, a TV, a display, a laptop computer, a digital photo frame, a navigator, etc.

A person skilled in the art may clearly understand that for the convenience and conciseness of the description, the specific working process of the external compensation circuit and each sub-circuit described above may be made reference to the corresponding process in the foregoing described method embodiment, and details will not be described herein again.

The foregoing descriptions are merely exemplary embodiments of the present disclosure, and are not intended to limit the present disclosure. Within the spirit and principles of the disclosure, any modifications, equivalent substitutions, improvements, etc., are within the protection scope of the present disclosure.

The invention claimed is:

1. An external compensation circuit, comprising: a regulation sub-circuit, and a compensation sub-circuit; wherein the regulation sub-circuit is connected to a reference current source, a current detection terminal of a pixel circuit, a first node and a second node respectively, and configured to regulate a potential at the first node and a potential at the second node according to a reference current provided by the reference current source, and configured to regulate the potential at the second node according to a collected driving current loaded to a light-emitting unit by the pixel circuit;

the compensation sub-circuit is connected to the first node, the second node, and a data signal terminal of the pixel circuit respectively, and configured to calibrate a data signal to be input to the pixel circuit according to a potential difference between the first node and the second node, and input the calibrated data signal to the pixel circuit; and the regulation sub-circuit comprises: a current amplifying portion and a potential regulating portion; wherein the current amplifying portion is connected to the reference current source, the current detection terminal of the pixel circuit, a third node and a fourth node respectively, and configured to amplify a collected current, and input the current that is amplified to the potential regulating portion through the third node and the fourth node, wherein the current is the reference current or the driving current; and the potential regulating portion is connected to the first node, the second node, the third node and the fourth node respectively, and configured to regulate the potential at the first node and the potential at the second node according to the reference current that is amplified, and regulate the potential at the second node according to the driving current that is amplified.

2. The circuit according to claim 1, wherein the current amplifying portion comprises: a first amplifier, a first resistance, a second resistance, a first switch, a second switch, a third switch, and a fourth switch; wherein a first input terminal of the first amplifier is connected to one terminal of the third switch, a second input terminal of the first amplifier is connected to a fifth node, and an output terminal of the first amplifier is connected to the third node, wherein another terminal of the third switch is connected to a direct current power source terminal;

one terminal of the first resistance is connected to one terminal of the second switch, and another terminal of the first resistance is connected to the fourth node, wherein another terminal of the second switch is connected to the fifth node;

one terminal of the second resistance is connected to the fourth node, and another terminal of the second resistance is connected to the direct current power source terminal;

one terminal of the first switch is connected to the fifth node, and another terminal of the first switch is connected to the third node; and a first terminal of the fourth switch is connected to the fifth node, a second node of the fourth switch is connected to the reference current source, and a third terminal of the fourth switch is connected to the current detection terminal of the pixel circuit.

3. The circuit according to claim 1, wherein the potential regulating portion comprises: a first transistor, a second transistor, a capacitor, and a fifth switch; wherein a gate of the first transistor is connected to the third node, a first electrode of the first transistor is connected to the second node, and a second electrode of the first transistor is connected to the fourth node;

a gate of the second transistor is connected to the first node, a first electrode of the second transistor is connected to one terminal of the capacitor, and a second electrode of the second transistor is connected to the second node, wherein another terminal of the capacitor is connected to the first node; and one terminal of the fifth switch is connected to the first node, and another terminal of the fifth switch is connected to the second node.

4. The circuit according to claim 1, wherein the compensation sub-circuit comprises: a control portion and a calibration portion; wherein the control portion is connected to the first node, the second node, and the calibration portion respectively, and configured to determine a compensation amount of a data signal according to the potential difference between the first node and the second node, and input the compensation amount to the calibration portion; and the calibration portion is further connected to the data signal terminal of the pixel circuit, and configured to calibrate the data signal to be input the pixel circuit according to the compensation amount received, and input a calibrated data signal to the pixel circuit.

5. The circuit according to claim 4, wherein the compensation sub-circuit further comprises: a storage portion connected to the control portion;

the storage portion is configured to store a corresponding relation between a potential difference and a compensation amount; and the control portion is configured to determine, according to the corresponding relation, a compensation amount corresponding to the potential difference between the first node and the second node as the compensation amount of the data signal.

6. The circuit according to claim 1, further comprising: a comparison sub-circuit; wherein the comparison sub-circuit is connected to the first node, the second node, and the compensation sub-circuit respectively, and configured to compare the potential at the first node with the potential at the second node, and input a comparison result to the compensation sub-circuit; and the compensation sub-circuit is configured to calibrate, when the potential at the first node is determined not to be equal to the potential at the second node according to the comparison result, the data signal to be input to the pixel circuit according to the potential difference between the first node and the second node.

7. The circuit according to claim 6, wherein the comparison sub-circuit further comprises: a comparator; wherein a first input terminal of the comparator is connected to the first node, a second input terminal of the comparator is connected to the second node, and an output terminal of the comparator is connected to the compensation sub-circuit.

8. The circuit according to claim 1, further comprising: an amplification sub-circuit; wherein the amplification sub-circuit is connected to the first node, the second node, and the compensation sub-circuit respectively, and configured to amplify the potential difference and input amplified potential difference to the compensation sub-circuit.

9. The circuit according to claim 8, wherein the amplification sub-circuit comprises: a second amplifier; wherein a first input terminal of the second amplifier is connected to the first node, a second input terminal of the second amplifier is connected to the second node, and an output terminal of the second amplifier is connected to the compensation sub-circuit.

10. The circuit according to claim 1, further comprising: a digital-to-analog converting sub-circuit; wherein the digital-to-analog converting sub-circuit is connected to the compensation sub-circuit and the data signal terminal of the pixel circuit respectively, and configured to convert the calibrated data signal input by the compensation sub-circuit into an analog signal and input the analog signal to the pixel circuit.

11. The circuit according to claim 10, wherein the regulation sub-circuit is further connected to the data signal terminal of the pixel circuit; and the digital-to-analog converting sub-circuit is connected to the data signal terminal of the pixel circuit through the regulation sub-circuit; the digital-to-analog converting sub-circuit comprises: a digital-to-analog converter and a sixth switch; wherein one terminal of the digital-to-analog converter is connected to the compensation sub-circuit, and another terminal of the digital-to-analog converter is connected to one terminal of the sixth switch; and another terminal of the sixth switch is connected to the regulation sub-circuit.

12. The circuit according to claim 2, further comprising a comparison sub-circuit, an amplification sub-circuit, and a digital-to-analog converting sub-circuit; wherein the potential regulating portion comprises a first transistor, a second transistor, a capacitor, and a fifth switch; the comparison sub-circuit comprises a comparator; the amplification sub-circuit comprises a second amplifier; the compensation sub-circuit comprises a control portion, a calibration portion, and a storing portion; and the digital-to-analog converting sub-circuit comprises a digital-to-analog converter and a sixth switch; wherein a gate of the first transistor is connected to the third node, a first electrode of the first transistor is connected to the second node, and a second electrode of the first transistor is connected to the fourth node;

a gate of the second transistor is connected to the first node, a first electrode of the second transistor is connected to one terminal of the capacitor, and a second electrode of the second transistor is connected to the second node, and another terminal of the capacitor is connected to the first node;

one terminal of the fifth switch is connected to the first node, and another terminal of the fifth switch is connected to the second node;

a first input terminal of the comparator is connected to the first node, a second input terminal of the comparator is connected to the second node, and an output terminal of the comparator is connected to the control portion;

a first input terminal of the second amplifier is connected to the first node, a second input terminal of the second amplifier is connected to the second node, and an output terminal of the second amplifier is connected to the control portion;

the control portion is further connected to the calibration portion and the storage portion respectively, and the calibration portion is further connected to one terminal of the digital-to-analog converter;

another terminal of the digital-to-analog converter is connected to one terminal of the sixth switch; and another terminal of the sixth switch is connected to the first input terminal of the first amplifier, and the output terminal of the first amplifier is further connected to the data signal terminal of the pixel circuit.

13. An external compensating method, applied to an external compensation circuit, wherein the external compensation circuit comprises: a regulation sub-circuit and a compensation sub-circuit; wherein the regulation sub-circuit is connected to a reference current source, a current detection terminal of a pixel circuit, a first node and a second node respectively; and the compensation sub-circuit is connected to the first node, the second node, and a data signal terminal of the pixel circuit respectively; the method comprising:

a reset phase, in which the regulation sub-circuit collects a reference current provided by the reference current source, and regulates a potential at the first node and a potential at a second node according to the reference current; and a detecting phase, in which the regulation sub-circuit collects a driving current loaded to a light-emitting unit by the pixel circuit and regulates the potential at the second node according to the driving current, and the compensation sub-circuit calibrates a data signal to be input to the pixel circuit according to a potential difference between the first node and the second node, and inputs a calibrated data signal to the pixel circuit;

wherein the regulation sub-circuit comprises: a current amplifying portion and a potential regulating portion; wherein the current amplifying portion is connected to the reference current source, the current detection terminal of the pixel circuit, a third node and a fourth node respectively, and configured to amplify a collected current, and input the current that is amplified to the potential regulating portion through the third node and the fourth node, wherein the current is the reference current or the driving current; and the potential regulating portion is connected to the first node, the second node, the third node and the fourth node respectively, and configured to regulate the potential at the first node and the potential at the second node according to the reference current that is amplified, and regulate the potential at the second node according to the driving current that is amplified.

14. The method according to claim 13, wherein the regulation sub-circuit comprises: a first amplifier, a first resistance, a second resistance, a first switch, a second switch, a third switch, a fourth switch, a first transistor, a second transistor, a capacitor, and a fifth switch; wherein in the reset phase, the first switch is switched off, the second switch, the third switch, and the fifth switch are switched on, and a first terminal and a second terminal of the fourth switch are coupled; and in the detecting phase, the first switch and the fifth switch are switched off, the second switch and the third switch are switched on, and the first terminal and a third terminal of the fourth switch are coupled.

15. The method according to claim 14, wherein an output terminal of the first amplifier is further connected to the data signal terminal of the pixel circuit; the external compensation circuit further comprises: a digital-to-analog converting sub-circuit that comprises a digital-to-analog converter and a sixth switch, and the digital-to-analog converter is connected to a first input terminal of the first amplifier through the sixth switch; the method further comprises: a light-emitting phase;

wherein, in the reset phase and the detecting phase, the sixth switch is opened; and in the light-emitting phase, the first switch and the sixth switch are switched on, the second switch, the third switch and the fifth switch are switched off, and the digital-to-analog converter inputs the calibrated data signal received to the data signal terminal of the pixel circuit through the sixth switch and the first amplifier, to drive the light-emitting unit connected to the pixel circuit to emit light.

16. The method according to claim 13, wherein the external compensation circuit further comprises: a comparison sub-circuit and an amplification sub-circuit; wherein in the detecting phase, the comparison sub-circuit compares the potential at the first node with the potential at the second node, and inputs a comparison result to the compensation sub-circuit; the amplification sub-circuit amplifies the potential difference and input amplified potential difference to the compensation sub-circuit; and the compensation sub-circuit calibrates, when the potential at the first node is determined to be not equal to the potential at the second node according to the comparison result, the data signal to be input to the pixel circuit according to the potential difference between the first node and the second node.

17. A display device, comprising: a pixel circuit and an external compensation circuit connected to the pixel circuit, wherein the external compensation circuit comprises: a regulation sub-circuit and a compensation sub-circuit; wherein the regulation sub-circuit is connected to a reference current source, a current detection terminal of the pixel circuit, a first node and a second node respectively, and configured to regulate a potential at the first node and a potential at the second node according to a reference current provided by the reference current source, and configured to regulate the potential at the second node according to a collected driving current loaded to the light-emitting unit by the pixel circuit;

the compensation sub-circuit is connected to the first node, the second node, and a data signal terminal of the pixel circuit respectively, and configured to calibrate a data signal to be input to the pixel circuit according to a potential difference between the first node and the second node, and input a calibrated data signal to the pixel circuit; and the regulation sub-circuit comprises: a current amplifying portion and a potential regulating portion; wherein the current amplifying portion is connected to the reference current source, the current detection terminal of the pixel circuit, a third node and a fourth node respectively, and configured to amplify a collected current, and input the current that is amplified to the potential regulating portion through the third node and the fourth node, wherein the current is the reference current or the driving current; and the potential regulating portion is connected to the first node, the second node, the third node and the fourth node respectively, and configured to regulate the potential at the first node and the potential at the second node according to the reference current that is amplified, and regulate the potential at the second node according to the driving current that is amplified.

18. The display device according to claim 17, wherein the pixel circuit comprises: a first switching transistor, a second switching transistor, a driving transistor, and a storage capacitor; wherein a gate of the first switching transistor is connected to a first switching signal terminal, a first electrode of the first switching transistor, as a data signal terminal, is connected to the compensation sub-circuit, and a second electrode of the first switching transistor is connected to a gate of the driving transistor;

a first electrode of the driving transistor is connected to a ground terminal, a second electrode of the driving transistor is connected to one terminal of the storage capacitor, another terminal of the storage capacitor is connected to a light-emitting unit; and a gate of the second switching transistor is connected to a second switching signal terminal, a first electrode of the second switching transistor is connected to one terminal of the storage capacitor, and a second electrode of the second switching transistor, as a current detection terminal, is connected to a third terminal of a fourth switch in the regulation sub-circuit.

19. The display device according to claim 17, wherein the compensation sub-circuit is connected to a first input terminal of a first amplifier in the regulation sub-circuit, and an output terminal of the first amplifier is further connected to the data signal terminal.

20. The display device according to claim 17, wherein the current amplifying portion comprises: a first amplifier, a first resistance, a second resistance, a first switch, a second switch, a third switch, and a fourth switch; wherein a first input terminal of the first amplifier is connected to one terminal of the third switch, a second input terminal of the first amplifier is connected to a fifth node, and an output terminal of the first amplifier is connected to the third node, wherein another terminal of the third switch is connected to a direct current power source terminal;

one terminal of the first resistance is connected to one terminal of the second switch, and another terminal of the first resistance is connected to the fourth node, wherein another terminal of the second switch is connected to the fifth node;

one terminal of the second resistance is connected to the fourth node, and another terminal of the second resistance is connected to the direct current power source terminal;

one terminal of the first switch is connected to the fifth node, and another terminal of the first switch is connected to the third node; and a first terminal of the fourth switch is connected to the fifth node, a second node of the fourth switch is connected to the reference current source, and a third terminal of the fourth switch is connected to the current detection terminal of the pixel circuit.

* * * * *